United States Patent [19]

King

[11] Patent Number: 4,743,053

[45] Date of Patent: May 10, 1988

[54] LATCH OPERATING MECHANISM

[76] Inventor: Derek King, 35 Badby Road, Daventry, Northamptonshire, England

[21] Appl. No.: 809,875

[22] Filed: Dec. 17, 1985

[51] Int. Cl.[4] ..... E05C 19/00

[52] U.S. Cl. ..... 292/139; 292/336.3

[58] Field of Search ..... 292/139, 142, 336.3, 292/DIG. 33

[56] References Cited

U.S. PATENT DOCUMENTS

| | | | |
|---|---|---|---|
| 1,513,797 | 11/1924 | Brabson | 292/142 X |
| 4,420,905 | 12/1983 | Kucharczyk | 292/139 X |

FOREIGN PATENT DOCUMENTS

| | | | |
|---|---|---|---|
| 0015814 | 2/1980 | European Pat. Off. . | |
| 1559735 | 8/1969 | Fed. Rep. of Germany | 292/142 |
| 1923525 | 12/1970 | Fed. Rep. of Germany | 292/142 |
| 2055341 | 5/1972 | Fed. Rep. of Germany | 292/142 |
| 2516305 | 11/1975 | Fed. Rep. of Germany | 292/142 |
| 200921 | 1/1966 | Sweden | 292/142 |
| 1504812 | 4/1975 | United Kingdom . | |
| 2072740 | 3/1981 | United Kingdom . | |

*Primary Examiner*—Richard E. Moore

*Attorney, Agent, or Firm*—Banner, Birch, McKie & Beckett

[57] ABSTRACT

A latch operating mechanism comprises a body part (10) for mounting on the frame of an openable glazed panel, a rotary handle (13) mounted on the body part by a spindle (28) a rack member (33) slidably mounted with respect to the body part and driven by a gear (30) within the housing which gear operably is connected to said handle. The rack member has a part (34) projecting from said body part for insertion through a slot in the frame and adapted to engage a part of an espanulette. The body part includes primary attachment locations (11) by which it is adapted to be secured to said frame, in which at least one primary attachment location is provided adjacent each end of the path of movement of the rack member.

10 Claims, 5 Drawing Sheets

FIG. 4.
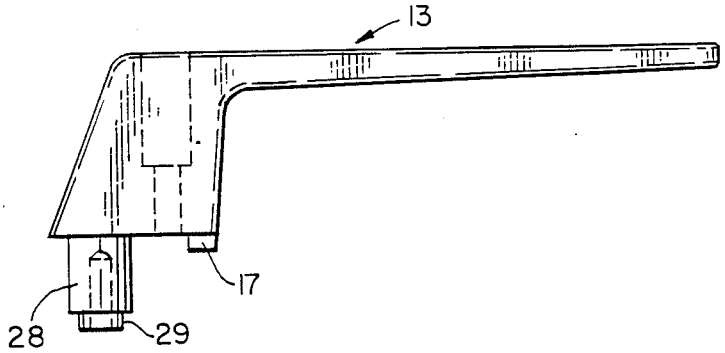
FIG. 4a.
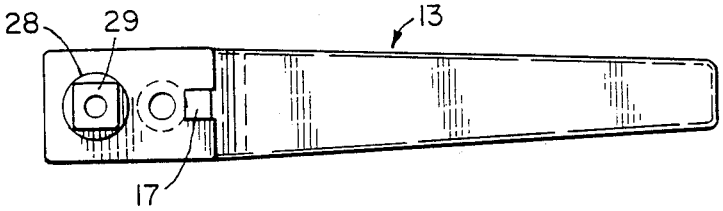
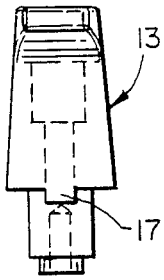
FIG. 4b.

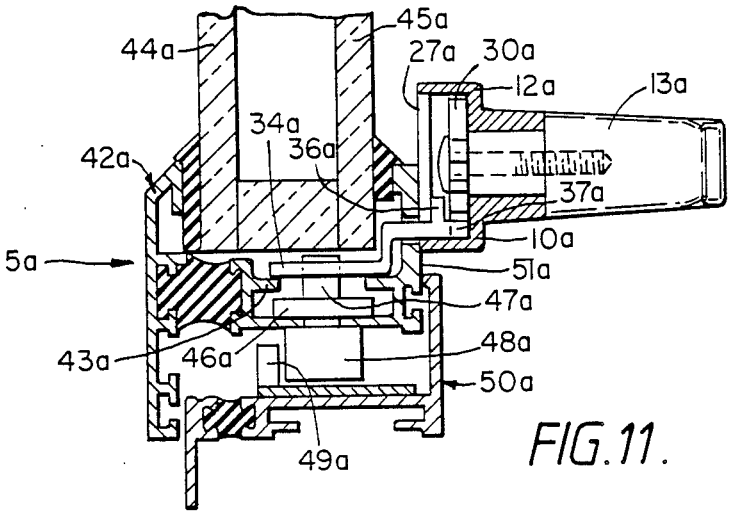
FIG. 11.
FIG. 12.
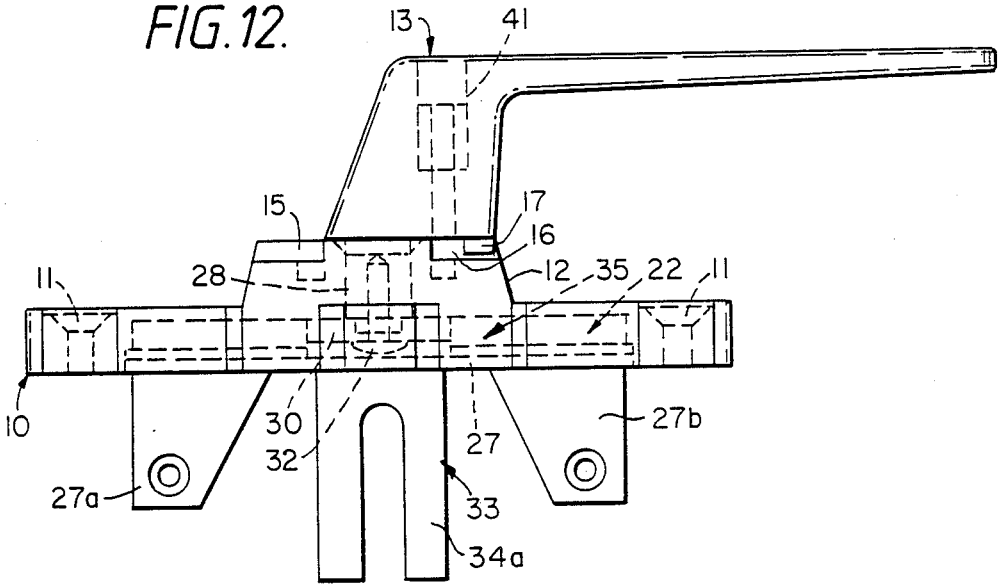

LATCH OPERATING MECHANISM

This invention relates to latch operating mechanisms suitable for use on openable glazed panels, e.g hinged windows.

Window frames are known which have, within the thickness of one side of the frame, a longitudinally movable slide bar or espanulette having at, or adjacent, each end thereof latching projections. The latching projections extend through slots in the wall of the frame to engage cooperating abutments on the fixed window surround, in the latched condition, to hold the window closed. Movement of the espanulette from the latched condition disengages the latching projections from the fixed abutments allowing the window to be opened. A conventional latch operating mechanism comprises a body part for securing to the window frame, a slidable member mounted on the body part and projecting through a slot in the frame to engage a part of the espanulette to control the movement of the espanulette, and a handle on the body part for operating the aforesaid slidable member. In such mechanism the handle has a spindle extending into the body part on which a spur gear is mounted. The aforesaid slidable member is provided with rack teeth engaged with the spur gear such that rotation of the handle and therefore of the spur gear causes sliding movement of the aforesaid slidable member and, in turn, longitudinal movement of the espanulette between its latched and unlatched position.

However, in prior constructions the relative positioning of the slidable member and the fixing locations by which the body part is secured to the window frame is such that conventional latch operating mechanisms are unsuitable for use on narrow window frames, particularly those made of plastic material, since they are too broad.

The invention is concerned with providing a latch operating mechanism suitable for use on relatively narrow framed windows for the type having internal slide bars with latching projections (espanulettes).

According to the present invention there is provided a latch operating mechanism comprising a body part for mounting on the frame of an openable glazed panel, a rotary handle mounted on the body part of a spindle, a rack member slidably mounted with respect to the body part and means driven by a gear within the housing which gear is operably connected to said handle, the rack member having a part projecting from said body part for insertion through an opening in the aforesaid frame and adapted to engage a part of an espanulette mounted therein, the body part having primary attachment locations by which it is adapted to be secured to said frame, said rack member being mounted for movement in a slot provided in said body part characterized in that at least one primary attachment location is provided adjacent each end of said slot in that said gear is contained within a central portion of the body which projects outwardly beyond one side of a part of the body which includes said slot and in that a notational plane passing through said primary attachment locations is spaced from a substantially parallel notational plane containing the axis of said spindle.

Another aspect of the invention provides an assembly of a latch operating mechanism as defined in the immediately preceding paragraph and a frame set comprising a fixed frame and a glazed frame which is openable with respect to the fixed frame, said central portion of said latch operating mechanism being raised and said mechanism being secured to a side face of the glazed frame such that said raised central portion of the body part extends beyond said side face in a direction which is remote from an adjacent part of the fixed frame when the glazed frame is in its closed position.

A mechanism in accordance with either aspect of the invention enables the width of the body part to be reduced in relation to the aforesaid conventional mechanisms while enabling a sufficient travel of the rack member to be achieved for each rotational operation of the handle.

Embodiments of the invention will now be described, by way of example, with reference to the accompanying drawings in which.

Figure 1:
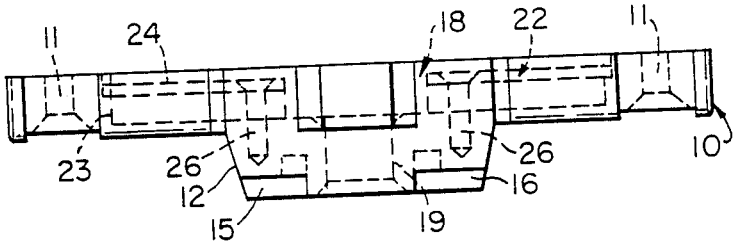
FIG. 1 is a side view of a housing of a latch operating mechanism in accordance with the invention.
Figure 2:
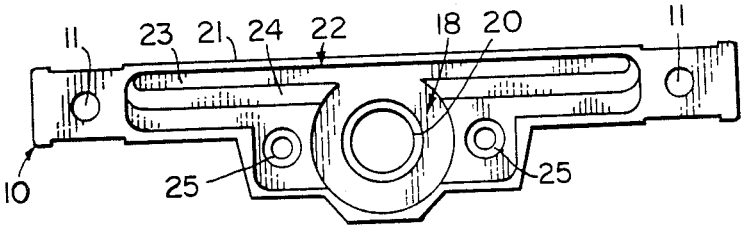
FIG. 2 is an underplan view of the housing of FIG. 1.
Figure 3:
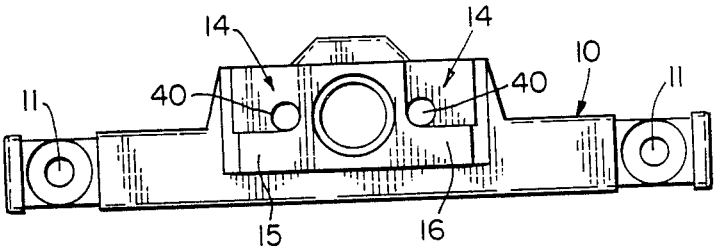
FIG. 3 is a plan view of the housing from above.
Figure 5:
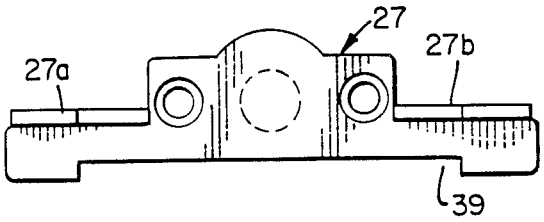
Figure 5A:
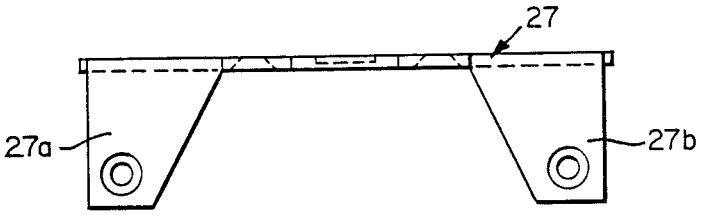
Figure 7:
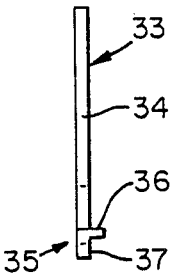
Figure 6:
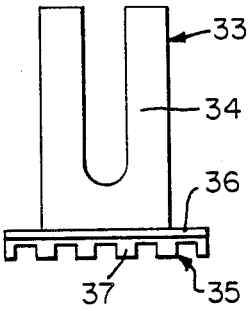
Figure 8:
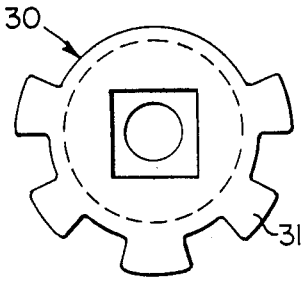
Figure 9:
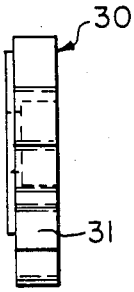
Figure 10:
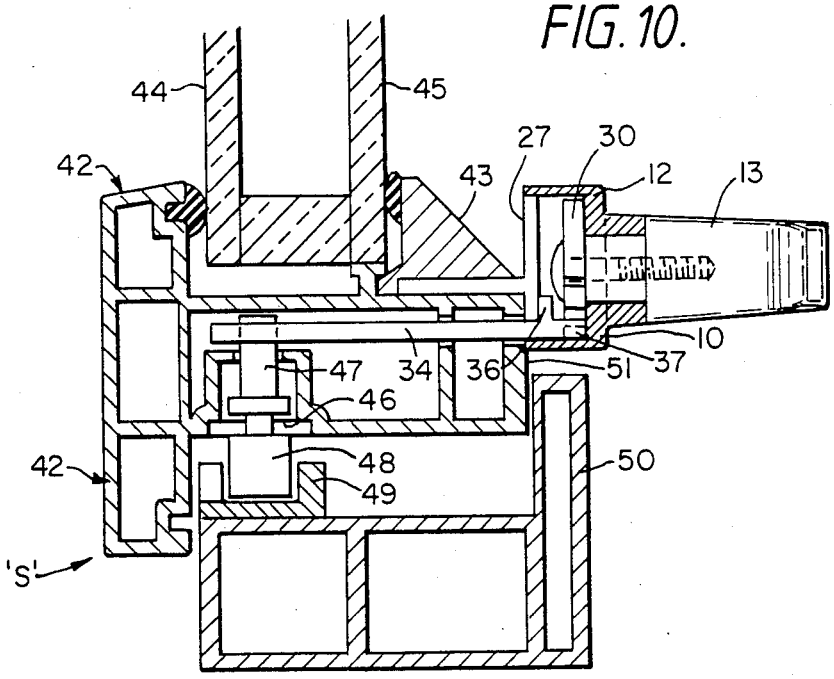

FIGS. 4, 4*a* and 4*b* are various views of an operating handle of the mechanism;

FIG. 5*a* is a plan view of one form of bottom plate for the housing of the mechanism;

FIG. 5*b* is a side view of a sliding fork plate of the mechanism;

FIG. 6 is a side view of a sliding fork plate of the mechansim;

FIG. 7 is an end view of the fork plate of FIG. 6;

FIGS. 8 and 9 are plan and side views of a spur gear of the mechanism;

FIGS. 10 and 11 are sectional views of an assembly comprising a fixed frame and an openable frame with the mechanism secured to the openable frame, FIG. 11 showing a modified latching mechanism, and FIG. 12 is a plan view of an assembled latch operating mechanism, having the bottom plate of FIGS. 5 and 5*a* and the cranked fork plate of the modification shown in FIG. 11.

Referring to the drawings, a latch operating mechanism for an openable window having a relatively narrow plastics or aluminium frame comprises a body part or housing 10 (FIGS. 1 to 3 and 12) having countersunk holes 11 therethrough for receiving screws for securing the housing of the window frame. The housing 10 has a raised central portion 12 on which a handle 13 ( FIGS. 4, 4*a*, 4*b*) is rotatably mounted. Side areas 14 of the raised central portion 12 are notched out to leave abutments 15 and 16 for engagement by a lug 17 on the handle 13 to define the extreme rotational positions thereof.

The housing is formed with a cavity 18 in its lower surface the cavity having a wall defined by a circle. A bore 19 extends through the raised portion 12 of the housing into the cavity 18 and is coaxial with the circle defining the cavity. A shallow blind bore 20 is formed centrally in the base of the cavity, for a purpose described below.

The base of the housing, which has a depending peripheral wall 21, is also formed with a longitudinal slot 22 which intersects the cavity 18 along one side thereof. The slot 22 is generally L-shaped in cross-section having a deep portion 23 adjacent the peripheral wall 21 of the housing and a shallow portion 24 extending from the deep portion 23 a short way towards the opposite longitudinal edge of the housing.

The housing 10 is further formed in its bottom surface with a pair of threaded bores 25 for receiving fixing screws 26 for securing a bottom plate 27 (FIG. 5) to the bottom of the housing.

The handle 13 has an integral spindle 28 which is rotatably received in the bore 19 to mount the handle on the raised central portion 12 of the housing. The spindle 28 has a square-sectioned end portion 29 which projects into the cavity 18 and on which a spur gear 30, having a square-sectioned central aperture is fixedly mounted. The spur-gear 30 is formed with five teeth 31 spaced about only a part of its periphery. The spur-gear 30 is secured to the spindle 28 by means of an Allen screw 32 (or other suitable fixing) whose head is received in the blind bore 20. Thus the gear is accommodated within the central portion of the housing which projects outwardly beyond one side of the part of the body which includes the slot 22.

FIGS. 6 and 7 show a fork plate 33 having a main clevis portion 34 for projecting from the housing into a slot in the window frame to which it is affixed, to engage and cooperate with a part of a slide bar mounted within the frame. The fork plate 33 has an integral mounting rack portion 35, which, as seen in FIG. 7 is generally L-shaped in cross-section to conform with the L-shaped slot 22 in the housing The transverse part 36 of the rack portion 35 engages in the shallow portion 24 of the housing slot 22 and the flange portion 37 thereof engages in the deep portion 23 of the housing slot. The flange portion 37 is formed with a series of racked teeth 38 which mesh with the spur gear 30 (as illustrated in FIG. 12) to be driven thereby. The mounting rack portion 35 is therefore slidably mounted in the L-shaped slot 22 in the housing for movement therealong when driven by the spur gear 30. The rack portion is retained in the slot 22 by the bottom plate 27 (FIG. 5) which is received within the depending peripheral wall 21 at the bottom of the housing and secured thereto by screws 26. The clevis portion 34 of the fork plate projects from the bottom of the housing through a slot 39 defined by the bottom plate 27 and an adjacent part of the housing.

Thus, it will be seen that the countersunk holes 11 to receive fixing screws of the mechanism are located adjacent the ends of the housing slot 22. Indeed, the fixing holes 11 are positioned such that the planes containing the clevis portion 34 of the fork plate 33 substantially passes through the fixing holes.

The first embodiment of the invention (FIG. 12) the bottom plate 27 is provided with a pair of flanges **27*a*, 27*b*, respectively, at its opposite ends each of which project outwardly at 90° to the plane of the plate. These flanges include apertures $a^1$, $a^2$ to receive suitable fasteners and provide secondary attachments by which the mechanism can be attached to the surface of the window frame which is normal to that on which the body part is mounted. This combined attachment arrangement provides a more secure mounting of the mechanism on the window frame. However, the flanges 27*a*, 27*b* may be omitted as in the mechanism of the assembly shown in FIG. 11**.

In operation, the handle is rotated from one extreme position to the other, defined by the engagement of the lug 17 on the handle with the abutments 15 and 16 defined on the raised central portion 12 of the housing. This causes rotation of the spur gear 30 thereby moving the fork plate 33 along the slot 22 in the housing, through the rack teeth 38 meshed with the spur gear 30.

A mechanism in accordance with the invention achieves a reduction in the overall width of the housing while providing a sufficient stroke of the fork plate.

Locking means may be provided for locking the handle in one or both of its extreme positions of rotational movement. One such means includes a pair of dimples or partspherical depressions 40 (FIGS. 1 and 3) formed in the raised portion 12 of the housing to receive an end portion of a securing screw which can be located in a bore provide through the handle which is brought into alignment with each depression 40 when the handle is moved to its respective extreme position. Another such means is a key operated barrel lock provided in an aperture 41 FIG. 12 in the handle.

FIG. 10 shows, in cross-section an assembly of a latching mechanism secured to an openable window frame and which incorporates the fork plate 33 illustrated in FIGS. 6 and 7.

The openable frame 42 of a frame set 'S' includes a horizontal section 43 in which one edge portion of a double glazed panel is accommodated. The double glazed panel comprises spaced glass plates 44 and 45 separated by an air gap as is well known. Opposite the double glazed panel the horizontal section 43 houses an espanulette 46 having an upstanding pin 47 which is engaged by the clevis portion 34 of the fork plate 33. The upstanding pin is connected to a latching projection 48 which engages a keeper or striker 49 provided by a fixed frame 50 in order to lock the openable frame to the fixed frame.

The housing 10 is secured to one side wall 51 of the openable frame by fixing screws passing through primary attachment locations (the countersunk holes 11) such that the raised central portion 12 extends beyond the upper surface of the openable frame remote from an adjacent part of the fixed frame. This construction permits the housing 10 to be secured to the limited space available on side wall 51 and allow the fork plate to pass through the openable frame for engagment with the espanulette.

The assembly shown in FIG. 10 is particularly suitable for a plastics frame construction.

FIG. 11 shows an assembly which incorporates aluminium frame component and a latching mechanism which is similar to that previously described. Like parts are designated like reference numerals with the addition of suffix 'a' However, in this modified arrangement the clevis portion **34*a* of the fork plate 33*a* is cranked towards the fixed frame 50*a* in order to clear the lower edge of the double glazed panel. Thus, clevis portion 34*a* includes a cranked portion 34*b* which is adjacent, but extends away from the bottom plate 27*a***.

It will be appreciated that in the constructions described, the transverse part **36, 36*a* of the fork plate 33, 33*a* is slidably supported between the bottom plate 27, 27*a* and shallow portion 24, 24*a*** of the housing slot.

I claim:

1. A latch operating mechanism comprising a body part for mounting on the frame of an openable glazed panel, a rotary handle mounted on the body part by a spindle, a rack member slidably mounted with respect to the body part and driven by a gear within the body part which gear is operably connected to said handle, the rack member having a part projecting from said body part for insertion through an opening in the aforesaid frame and adapted to engage a part of an espanulette mounted therein, the body part having primary attachment locations by which it is adapted to be secured to said frame, said rack member being mounted for movement in a slot provided in said body part characterised in that at least one primary attachment location is provided adjacent each end of said slot, in that said gear is contained within a central portion of the body which projects outwardly beyond one side of a part of the body which includes said slot and in that a notional plane passing through said primary attachment locations is spaced from a substantially parallel notional plane containing the axis of said spindle, said notional plane which passes through said primary attachment locations containing at least that portion of the projecting part of the rack member which is adjacent but external of the body part.

2. A latch operating mechanism according to claim 1 further characterised in that the rack member is cranked to provide a shoulder portion intermediate its ends external of the body part which shoulder portion extends in an outward direction in relation to the spindle axis.

3. A latch operating mechanism according to claim 2, further characterised in that a portion of the projecting part of the rack member beyond said shoulder portion and remote from said body part lies in a plane which is adjacent to or outside a side face of said body part.

4. A latch operating mechanism according to claim 2, further characterised in that the rack member includes a transverse part intermediate its ends and projecting therefrom internally of said body part, said transverse part being slidable on a ledge within the body part provided by a shallow portion of said slot to aid in guiding the rack member.

5. A latch operating mechanism according to claim 1, further characterised in that teeth of the rack member meshing with said gear are provided at one end of the rack member internally of the body part said end being located in a deep portion of said housing slot.

6. A latch operating mechanism according to claim 4, further characterised in that the rack member is retained within the body part by a bottom plate which plate abuts one face of said transverse part which is remote from that face which is slidable on said ledge.

7. A latch operating mechanism according to claim 1, further characterised in that said projecting part of the rack member comprises a clevis portion for engagement with a projection provided by said espanulette.

8. A latch operating mechanism according to claim 1, further characterised in that the mechanism includes secondary attachment locations for attaching the mechanism to a surface of said frame which is normal to that on which the body part is mounted.

9. A latch operating mechanism according to claim 8, further characterised in that said secondary attachment locations are provided by at least one flange projecting substantially parallel of the plane of said projecting part of said rack member.

10. The assembly of a latch operating mechanism as defined in claim 1, and a frame set comprising a fixed frame and a glazed frame which is openable with respect to the fixed frame, said central portion of said latch operating mechanism being raised and the mechanism being secured to a side face of the glazed frame such that said riased central portion of the body part extend beyond said side face in a direction which is remote from an adjacent part of the fixed frame when the glazed frame is in its closed position.

* * * * *

UNITED STATES PATENT AND TRADEMARK OFFICE

CERTIFICATE OF CORRECTION

PATENT NO. : 4,743,053

DATED : May 10, 1988

INVENTOR(S) : Derek King

It is certified that error appears in the above-identified patent and that said Letters Patent is hereby corrected as shown below:

Column 1, line 45, "of" should be —by—;

Column 3, line 24, after "housing" insert a period —.—;

Column 4, line 44, after " 'a' " insert a period —.—;

Claim 10, Column 6, line 28, "riased" should be —raised—; and

Claim 10, Column 6, line 29, "extend" should be —extends—.

Signed and Sealed this

Thirteenth Day of September, 1988

*Attest:*

DONALD J. QUIGG

*Attesting Officer*

*Commissioner of Patents and Trademarks*